US010501833B2

(12) United States Patent
Hentschel et al.

(10) Patent No.: US 10,501,833 B2
(45) Date of Patent: Dec. 10, 2019

(54) ALUMINUM ALLOY FOR PRODUCING SEMI-FINISHED PRODUCTS OR COMPONENTS FOR MOTOR VEHICLES, METHOD FOR PRODUCING AN ALUMINIUM ALLOY STRIP FROM SAID ALUMINIUM ALLOY, AND ALUMINIUM ALLOY STRIP AND USES THEREFORE

(71) Applicants: Thomas Hentschel, Bonn (DE); Henk-Jan Brinkman, Bonn (DE); Olaf Engler, Bonn (DE); Réginald Dupuis, Grevenbroich-Kapellen (DE)

(72) Inventors: Thomas Hentschel, Bonn (DE); Henk-Jan Brinkman, Bonn (DE); Olaf Engler, Bonn (DE); Réginald Dupuis, Grevenbroich-Kapellen (DE)

(73) Assignee: Hydro Aluminum Rolled Products GmbH, Grevenbroich (DE)

( * ) Notice: Subject to any disclaimer, the term of this patent is extended or adjusted under 35 U.S.C. 154(b) by 0 days.

(21) Appl. No.: 14/826,244

(22) Filed: Aug. 14, 2015

(65) Prior Publication Data

US 2015/0368771 A1 Dec. 24, 2015

Related U.S. Application Data

(63) Continuation of application No. PCT/EP2014/053323, filed on Feb. 20, 2014.

(30) Foreign Application Priority Data

Feb. 21, 2013 (EP) ..... 13156100

(51) Int. Cl.
*C22F 1/04* (2006.01)
*C22C 21/00* (2006.01)
*B22D 7/00* (2006.01)

(52) U.S. Cl.
CPC ..... *C22F 1/04* (2013.01); *B22D 7/005* (2013.01); *C22C 21/00* (2013.01)

(58) Field of Classification Search
CPC ..... C22C 21/00; C22F 1/04
See application file for complete search history.

(56) References Cited

U.S. PATENT DOCUMENTS 5,028,276 A 7/1991 Byrne et al.
5,125,452 A 6/1992 Yamauchi et al.
(Continued)

FOREIGN PATENT DOCUMENTS

CN 101956102 A 1/2011
EA 3850 B1 10/2003
(Continued)

OTHER PUBLICATIONS

Davis, J.R. 'Aluminum and Aluminum Alloys', ASM International, 1993, p. 21.*
(Continued)

*Primary Examiner* — George Wyszomierski
*Assistant Examiner* — Janell C Morillo
(74) *Attorney, Agent, or Firm* — Reinhart Boerner Van Deuren P.C.

(57) ABSTRACT

An aluminium alloy for producing semi-finished products or components for motor vehicles is provided, wherein the alloying components of the aluminium alloy have the following contents in percent by weight: Fe≤0.80%, Si≤0.50%, 0.90%≤Mn≤1.50%, Mg≤0.25%, Cu≤0.125%, Cr≤0.05%, Ti≤0.05%, V≤0.05%, Zr≤0.05%, the remainder being aluminium, unavoidable impurity elements, individually <0.05%, in total <0.15%, and the combined content of Mg and Cu satisfies the following relation in percent by weight: 0.15%≤Mg+Cu≤0.25%, wherein the Mg content of the aluminium alloy is greater than the Cu content of the aluminium alloy. A method for producing an aluminium alloy strip from such an aluminium alloy and an aluminium alloy strip produced by this method are also provided, as well as uses thereof.

9 Claims, 4 Drawing Sheets

(56) References Cited

U.S. PATENT DOCUMENTS

| | | | | |
|---|---|---|---|---|
| 5,547,524 | A | 8/1996 | Sainfort et al. | |
| 6,447,982 | B1 * | 9/2002 | von Asten | B41N 3/034 101/459 |
| 2005/0217770 | A1 | 10/2005 | Lequeu et al. | |
| 2006/0014043 | A1 * | 1/2006 | Haller | B23K 35/286 428/654 |
| 2009/0090437 | A1 | 4/2009 | ten Cate et al. | |
| 2010/0279143 | A1 | 11/2010 | Kamat et al. | |
| 2013/0118013 | A1 * | 5/2013 | Yamashita | B23K 1/0012 29/890.046 |
| 2015/0188145 | A1 * | 7/2015 | Furutani | C22C 21/00 429/245 |
| 2016/0076126 | A1 * | 3/2016 | Go | B22D 7/005 420/532 |

FOREIGN PATENT DOCUMENTS

| | | | | |
|---|---|---|---|---|
| EP | 0823305 | A2 | 2/1998 | |
| EP | 1 075 935 | A1 | 2/2001 | |
| EP | 2123386 | A1 | 11/2009 | |
| FR | 2 897 319 | A1 | 8/2007 | |
| GB | 2 159 175 | A | 11/1985 | |
| JP | 59-85837 | A | 5/1984 | |
| JP | 03-215645 | A | 9/1991 | |
| JP | 03-222796 | A | 10/1991 | |
| JP | WO 2011148781 | A1 * | 12/2011 | B23K 1/0012 |
| JP | 2012149354 | A | 8/2012 | |
| RU | 2 221 891 | C1 | 1/2004 | |
| RU | 2 266 348 | C2 | 12/2005 | |
| RU | 2 345 172 | C2 | 1/2009 | |
| WO | WO 2005/118899 | A1 | 12/2005 | |

OTHER PUBLICATIONS

The Aluminum Association; International Alloy Designations and Chemical Composition Limits for Wrought Aluminum and Wrought Aluminum Alloys; Publication; 2009; 2 pages.
Aleris Aluminum Koblenz Gmbh; Inspection Certificate (EN 10204/3.1); 2011; 9 pages.
European Aluminium Association; The Aluminium Association Automotive Manual; Manual; 2011; 20 pages.
Govindaraj et al.; Threshold Deformation for Exhibiting the Hardening on Annealing Behaviour in AA3103 Alloy; Publication; TMS (The Minerals, Metals & Materials Society) 2012; 6 pages.
Van Der Zwaag; Microchemistry in aluminium sheet production; Publication; 2005; 173 pages.
Håkonsen et al.; Modelling the Metallurgical Reactions During Homogenization of an AA3103 Alloy; Publication; Light Metals 2002; 8 pages.
Langerweger et al.; Influence of Homogenizing on the Properties of Cast Aluminium Products; Publication; Light Metals 1982; 7 pages.
European Aluminium Association; The Aluminium Automotive Manual, Rolled Products; Manual; 2002; 42 pages.
American Society for Metals; Aluminum, Properties and Physical Metallurgy; 1984; 4 pages.
Aluminum Headquarters, Düsseldorf; Aluminum Paperback; 1988; 6 pages.
ASM International, The Materials Information Society; ASM Specialty Handbook, Aluminum and Aluminum Alloys; Manual; 1993; 4 pages.
40th Anniversary Celebration Executive Committee, Celebration Publishing Group, Structures and Properties of Aluminum, The Japan Institute of Light Metals, Nov. 30, 1991, p. 441-443.
50th Anniversary Celebration Executive Committee, Celebration Publishing Group, Products and Manufacturing Technique of Aluminum, The Japan Institute of Light Metals, Oct. 31, 2001, p. 408-411.
Deutsche Bank, bank transactions regarding delivery note 0374105, Jun. 1, 2011, 2 pages.
Deutsche Bank, bank transactions regarding delivery note 0670830, Aug. 15, 2012, 2 pages.
Internet video, https://www.youtube.com/watch?v=UQfDGNUlkr8, Dürr AG RoDip Kathodische Tauchlackierung (Electro-dip painting); uploaded Nov. 12, 2010; page printed from a website.
Internet video, https://www.youtube.com/watch?v=cR7U8s9lq94, Hauchdünne Brillanz—Hightech in der Audi Lackiererei; uploaded Dec. 23, 2009; page printed from a website.
Internet video, https://www.youtube.com/watch?v=JauUjmXITPE, uploaded Feb. 19, 2010.
Internet video, https://www.youtube.com/watch?v=O0ScFQ1rbe4, BMW Paint Shop; uploaded Sep. 26, 2012; page printed from a website.
Internet video, https://www.youtube.com/watch?v=XyrWP4yNvXq, Eisenmann—VarioShutte v4; uploaded Dec. 15, 2010; page printed from a website.
EPO, "Zwischenentscheidung im Einspruchsverfahren," regarding European Patent EP 2 959 028, Dec. 20, 2018, 18 pages.
Deutsche Bank, bank transaction with Deutsche Bank, Jun. 2, 2011, 2 pages.
T. Itagaki K Torma, "Development of Aluminum Alloys for Heat Exchangers Manufactured by Brazing", Proceedings of International Conference on Recent Advances in Science and Engineering of Light Metals, pp. 629-634 Published by The Japan Institute of Light Metals, Tokyo, Oct. 1991.
D. Altehpohl, "Aluminium und Aluminiumlegierungen", pp. 700-701, Springer-Verlag Berlin/Göttingen/Heidelberg/New-York, 1965.
"Aluminium Handbook 1" pp. 118-121, Published by Aluminium-Zentrale e.V., Am Bonneshof, 40474 Diisseldorf Germany, 1999.
"Aluminum Properties and Physical Metallurgy", pp. 356-361—J. Hatch Ed. Published by the American Society for Metals, 1984.
"Aluminum and Aluminum Alloys" pp. 665-668—J.R. Davis Ed Published by ASM International, Materials Park, 1993.

* cited by examiner

ALUMINUM ALLOY FOR PRODUCING SEMI-FINISHED PRODUCTS OR COMPONENTS FOR MOTOR VEHICLES, METHOD FOR PRODUCING AN ALUMINIUM ALLOY STRIP FROM SAID ALUMINIUM ALLOY, AND ALUMINIUM ALLOY STRIP AND USES THEREFORE

CROSS-REFERENCE TO RELATED PATENT APPLICATIONS

This patent application is a continuation of PCT/EP2014/053323, filed Feb. 20, 2014, which claims priority to European Application No. 13 156 100.3, filed Feb. 21, 2013, the entire teachings and disclosure of which are incorporated herein by reference thereto.

FIELD OF THE INVENTION

The invention relates to an aluminium alloy for producing semi-finished products or components for motor vehicles. The invention further relates to a method for producing an aluminium alloy strip, and to a correspondingly produced aluminium alloy strip, and uses therefore.

BACKGROUND OF THE INVENTION

Semi-finished products and components for motor vehicles must satisfy various requirements depending on their location and purpose of use in a motor vehicle, particularly in terms of their mechanical properties and corrosion properties.

In the case of interior door panels, for example, the mechanical properties are mainly determined by stiffness, which particularly depends on the shaping of said parts. By comparison, strength is less influential, though the materials used must not be too soft either. At the same time, good formability is very important since the parts and semi-finished products generally undergo complex forming processes, for example for producing interior door panels. This applies particularly to components that are prepared in a one-part sheet metal shell construction, such as for example a sheet metal interior door with integral window frame area. By eliminating joining operations, such components offer cost advantages over an attached profile solution for the window frame.

It would be particularly advantageous if a corresponding semi-finished product or component could be formed from an aluminium alloy on a tool for steel components, since aluminium or steel components could then be produced as needed on the same tool, thereby reducing or eliminating investment and operating costs for an additional tool.

For the reasons mentioned above, there is great interest in the automobile industry for medium-strength aluminium alloys with very good formability, particularly if they have better formability than the standard alloy AA (Aluminium Association) 5005 (AlMg1), for example.

Besides mechanical properties, corrosion resistance is also a major consideration for motor vehicles since motor vehicle components such as interior door panels are exposed to splashed, condensation or perspiration water. It is therefore desirable for the motor vehicle components to have good resistance to various corrosive attacks, particularly intercrystalline corrosion and filiform corrosion.

Filiform corrosion is the term used for a corrosion type that occurs on coated components and has a thread-like pattern. Filiform corrosion occurs in high humidity in the presence of chloride ions.

Attempts have been made in the past to produce semi-finished products and components for motor vehicles from the alloy AA 8006 (AlFe1.5Mn0.5). Although semi-finished products having sufficient strength and very good formability can be produced with this alloy, the corresponding components were highly susceptible to filiform corrosion after painting, so that the alloy AA 8006 is not suitable for coated, particularly painted components such as interior door panels.

Curable AA 6xxx alloys are very strong and have good resistance to intercrystalline and filiform corrosion, but they are considerably more difficult to form than AA 8006, and therefore not well suitable for producing complex parts such as for example interior door panels. Moreover, production of semi-finished products and components from an AA 6xxx alloy is very complex and expensive, since they must undergo continuous annealing as a special process step.

AA 5xxx alloys with high magnesium content combine good strength properties with very good formability. However, this formability is not equal to those of steel solutions, which leads to restrictions in the design of the components. Moreover, said alloys are prone to intercrystalline corrosion. Steel materials have high formability, but their weight is unfavourable for the same stiffness, and they are also susceptible to corrosion.

SUMMARY OF THE INVENTION

Based on this prior art, the present invention is based on the object of providing an aluminium alloy for producing semi-finished products or components for motor vehicles, which has very good formability, has medium strength and is resistant to corrosion. Further, a corresponding method for producing aluminium alloy strips from said aluminium alloy shall be provided, which method can be implemented relatively inexpensively. Finally, the present invention is also based on the object of producing a corresponding aluminium alloy strip and of providing advantageous uses for the strip and the alloy.

Regarding the aluminium alloy, the aforementioned object is achieved according to the invention in that the components of the aluminium alloy have the following contents in percent by weight:

$Fe \leq 0.80\%$,
$Si \leq 0.50\%$,
$0.90\% \leq Mn \leq 1.50\%$,
$Mg \leq 0.25\%$,
$Cu \leq 0.20\%$,
$Cr \leq 0.05\%$,
$Ti \leq 0.05\%$,
$V \leq 0.05\%$,
$Zr \leq 0.05\%$, the remainder being aluminium, unavoidable impurity elements individually <0.05%, in total <0.15%, and the combined content of Mg and Cu satisfies the following relation in % by weight $0.15\% \leq Mg+Cu \leq 0.25\%$.

The aluminium alloy according to the invention is based on the AA 3xxx alloy type, particularly AA 3103 (AlMn1). Although such alloys have very good formability, they are usually too soft for many applications such as motor vehicle components. While the strength of the aluminium alloy can be increased by adding certain alloying elements, particularly Mg and Cu, but this also brings about a significant reduction in ductility and therewith also inferior formability.

One of the discoveries made as part of the invention was that the combined content of copper and magnesium must be controlled precisely in the aluminium alloy according to the invention in order to obtain the desired mechanical properties, that is to say an offset yield strength $R_{p0.2}$ of at least 45 MPa with uniform elongation $A_g$ of at least 23%, and an elongation at break $A_{80mm}$ of at least 30%, and good corrosion resistance. In experiments, it was found that a combination of strength and formability of the aluminium alloy that is advantageous for the applications described is achieved with a combined content of Mg and Cu between 0.15 and 0.25% by weight.

In particular, the combined content of magnesium and copper must be at least 0.15% by weight, preferably at least 0.16% by weight, especially at least 0.17% by weight to endow the aluminium alloy with sufficient strength, particularly with an offset yield strength $R_{p0.2}$ of at least 45 MPa. On the other hand, the combined content of Mg and Cu must be limited to at most 0.25% by weight, preferably at most 0.23% by weight, particularly at most 0.20% by weight, since otherwise the uniform elongation $A_g$ and elongation at break $A_{80mm}$ are reduced too much, namely in particular below 23% for $A_g$ and below 30% for $A_{80mm}$. The combined content of magnesium and copper is generally understood to be the sum of the two individual contents of Mg and Cu in % by weight.

Regarding the individual contents, the aluminium alloy has a Cu content of at most 0.20% by weight, preferably at most 0.125% by weight, more preferably at most 0.10% by weight, particularly at most 0.05% by weight, and a magnesium content of at most 0.25% by weight, preferably at most 0.2% by weight. The aluminium alloy further has a Mg content of preferably at least 0.06% by weight, more preferably at least 0.10% by weight, particularly at least 0.15% by weight. In one embodiment, the aluminium alloy has a Mg content preferably in the range from 0.08% by weight to 0.25% by weight.

The aluminium alloy according to the invention as described above was proven in tests to have high formability and medium strength. Accordingly, the aluminium alloy can be used especially well for semi-finished products and motor vehicle components, the preparation of which involves complex forming processes. Accordingly, the invention also relates to the use of the aforementioned aluminium alloy to produce a semi-finished product or motor vehicle component. Under certain circumstances, it is even possible to achieve such good formability with the aluminium alloy that semi-finished products and components may be formed from the alloy on forming tools for steel components.

Moreover, it has been shown in experiments that the aluminium alloy according to the invention has good corrosion resistance. In particular, intercrystalline corrosion does not occur in AA 3xxx type alloys, to which the alloy described in the preceding belongs. Further, in laboratory tests the aluminium alloy according to the invention proved to have significantly better resistance to filiform corrosion than AA 8006 alloys, for example.

The effect of the individual alloying components will now be explained in the following:

In combination with the Fe and Si contents in the amounts indicated, the Mn content in the alloy from 0.9 to 1.5% by weight, preferably from 1.0 to 1.4% by weight, particularly from 1.0 to 1.2% by weight, results in particular in relatively uniformly distributed, compact particles of the quaternary α-Al(Fe,Mn)Si phase, which increase the strength of the aluminium alloy without negatively affecting other properties such as formability or corrosion behaviour.

The elements titanium, chromium, vanadium and in particular zirconium can interfere with recrystallization during final annealing, thus negatively affecting the formability of the aluminium alloy. In order to achieve better formability, the aluminium alloy has Ti, Cr, V and Zr contents of at most 0.05% by weight each, and preferably a Zr content of at most 0.02% by weight.

The contents of all other unavoidable impurity elements are individually less than 0.05% by weight and in total less than 0.15% by weight, so that they do not lead to any undesirable phase formation and/or negative effects on the material properties.

In a first preferred embodiment, the Mg content of the aluminium alloy is greater than the Cu content of the aluminium alloy. In this way, the corrosion behaviour of the aluminium alloy may be further improved, particularly with regard to filiform corrosion. Accordingly, tests for filiform corrosion on sheet metal samples made from various aluminium alloys have shown that aluminium alloys according to this first embodiment can be used to make aluminium workpieces, particularly semi-finished products or components for motor vehicles, in which very little or practically no filiform corrosion occurs in the tests.

In a further embodiment, the formability of the aluminium alloy is further improved in that the aluminium alloy has a Cr content ≤0.02% by weight, preferably ≤0.01% by weight, and/or a V content ≤0.02% by weight, preferably ≤0.01% by weight, and/or a Zr content ≤0.01% by weight.

Titanium may be added as grain refiner, for example in the form of Ti-boride-wire or -rods during continuous casting of the aluminium alloy. Accordingly, in a further embodiment the aluminium alloy has a Ti content of at least 0.01% by weight, preferably at least 0.015% by weight, particularly at least 0.02% by weight.

In a further embodiment, the material properties of the aluminium alloy may be improved in that the aluminium alloy has an Fe content ≤0.7% by weight, preferably ≤0.6% by weight, particularly ≤0.5% by weight. By further limiting the Fe content it is prevented that the susceptibility of the aluminium alloy to filiform corrosion increases.

Further, the aluminium alloy preferably has a Si content of ≤0.4% by weight, preferably ≤0.3% by weight, particularly ≤0.25% by weight. Limiting the Si content further can prevent the alloy from losing too much formability.

To increase its strength, the aluminium alloy preferably further has an Fe content of at least 0.10% by weight, preferably at least 0.25% by weight, particularly at least 0.40% by weight, and/or a Si content of at least 0.06% by weight, preferably at least 0.10% by weight, particularly at least 0.15% by weight.

In a preferred embodiment of the aluminium alloy, good strength and formability are achieved in that the alloying components of the aluminium alloy have the following contents in percent by weight:

0.40%≤Fe≤0.70%,
0.10%≤Si≤0.25%,
1.00%≤Mn≤1.20%,
Mg≤0.25%,
Cu≤0.10%,
Cr≤0.02%,
Ti≤0.05%,
V≤0.05%,
Zr≤0.05%, the remainder being aluminium, unavoidable impurity elements individually <0.05%, in total <0.15%, wherein the combined content of Mg and Cu satisfies the following relation in % by weight 0.15%≤Mg+Cu≤0.25%.

The formability of this alloy can be improved in that the alloy has a V content of ≤0.02% by weight and/or a Zr content of ≤0.01% by weight. Further, the grain refinement can also be improved with a Ti content of at least 0.01% by weight.

In a preferred embodiment of the aluminium alloy, very good formability and adequate strength are achieved in that the alloying components of the aluminium alloy have the following contents in percent by weight:

0.40%≤Fe≤0.70%,
0.10%≤Si≤0.25%,
1.00%≤Mn≤1.20%,
Mg≤0.20%,
Cu≤0.05%,
Cr≤0.02%,
Ti≤0.05%,
V≤0.05%,
Zr≤0.05%, the remainder being aluminium, unavoidable impurity elements individually <0.05%, in total <0.15%, wherein the combined content of Mg and Cu satisfies the following relation in % by weight 0.15%≤Mg+Cu≤0.20%.

The formability of this alloy can be improved in that the alloy has a V content of ≤0.02% by weight and/or a Zr content of ≤0.01% by weight. Further, the grain refinement can be improved with a Ti content of at least 0.01% by weight.

The object described above is further solved according to the invention with a method for producing an aluminium alloy strip from an aluminium alloy according to the invention, comprising the following method steps:

Casting a rolling ingot from an aluminium alloy according to the invention;

Homogenizing the rolling ingot at 480° C. to 600° C. for at least 0.5 h;

Hot rolling the rolling ingot at 280° C. to 500° C. to form an aluminium alloy strip;

Cold rolling the aluminium alloy strip to final thickness; and

Subjecting the aluminium alloy strip to recrystallizing final annealing.

The steps of the method described above are particularly carried out in the given order.

It was found in experiments that with this method it is possible to produce an aluminium alloy strip of high formability, medium strength and which is resistant to corrosion, especially with respect to intercrystalline corrosion and filiform corrosion. Furthermore, with this method it is possible to produce the aluminium alloy strip economically, since the method comprises standard process steps (i.e., continuous casting, homogenizing, hot rolling, cold rolling, soft annealing) and does not necessarily require special, complicated process steps such as a continuous strip annealing.

The rolling ingot is preferably cast in DC continuous casting. Alternatively, however, a strip casting method, for example, may also be used.

The effect of homogenizing the rolling ingot at 480° C. to 600° C., preferably at 500° C. to 600° C., particularly at 530° C. to 580° C., for at least 0.5 h, is that after the final annealing the aluminium alloy strip has a fine-grained microstructure with good strength and formability. These properties may be further improved in that the rolling ingot is homogenized for at least 2 h.

Hot rolling of the rolling ingot is carried out at a temperature between 280° C. and 500° C., preferably between 300° C. and 400° C., particularly between 320° C. and 380° C. During hot rolling, the rolling ingot is preferably rolled down to a thickness between 3 and 12 mm. This ensures that during the subsequent cold rolling, a sufficient degree of rolling reduction is reached, preferably of at least 70%, particularly at least 80%, which is a co-determining factor of the strength, formability and elongation values of the aluminium alloy strip.

The aluminium alloy strip may undergo cold rolling in one or more passes. The aluminium alloy strip is preferably rolled to a final thickness in the range from 0.2 to 5 mm, preferably from 0.25 to 4 mm, particularly from 0.5-3.6 mm. These thickness ranges are particularly well suited for achieving the desired material properties of the aluminium alloy strip.

With final annealing of the aluminium strip it is possible to obtain a fine-grained, fully crystalline microstructure with good strength and formability. Therefore, the final annealing process is a recrystallizing soft annealing step. Final annealing may be carried out in particular in a chamber furnace at a temperature from 300° C. to 400° C., preferably from 320° C. to 360° C., or in a continuous furnace at a temperature from 450° C. to 550° C., preferably from 470° C. to 530° C. The chamber furnace is less expensive to buy and operate than the continuous furnace. Final annealing typically takes 1 h or more in a chamber furnace.

In a first embodiment of the method, the method comprises the following additional step:

Milling the upper and/or lower side of the rolling ingot.

This method step helps to improve the corrosion properties of the produced aluminium alloy strip and of a final product made from said aluminium alloy strip, respectively. The upper and/or lower side of the rolling ingot may be milled for example after casting and before homogenization of the rolling ingot.

In a further embodiment of the method, homogenization is carried out in at least two stages and comprises the following steps:

first homogenization at 500° C. to 600° C., preferably at 550° C. to 600° C., for at least 0.5 h, preferably at least 2 h; and second homogenization at 450° C. to 550° C. for at least 0.5 h, preferably at least 2 h.

With the at least two-stage homogenization, it is possible to obtain a finer grained microstructure with good strength and formability after the final annealing. It has been found that by this method, after final annealing it is possible to obtain particle sizes smaller than 45 μm, particularly even smaller than 35 μm, as determined according to ASTM E1382. The second homogenization is preferably carried out at the hot rolling temperature which the rolling ingot has at the beginning of the subsequent hot rolling step.

In a further embodiment, the at least two-stage homogenization preferably comprises the following steps:

first homogenization at 500° C. to 600° C., preferably at 550° C. to 600° C., for at least 0.5 h, preferably at least 2 h;

cooling of the rolling ingot after the first homogenization to the temperature for the second homogenization; and second homogenization at 450° C. to 550° C. for at least 0.5 h, preferably at least 2 h.

In an alternative embodiment, the at least two-stage homogenization preferably comprises the following steps:

first homogenization at 500° C. to 600° C., preferably at 550° C. to 600° C., for at least 0.5 h, preferably at least 2 h;

cooling of the rolling ingot to room temperature after the first homogenization;

warming of the rolling ingot to the temperature for the second homogenization; and second homogenization at 450° C. to 550° C. for at least 0.5 h, preferably at least 2 h.

In a further embodiment, a step of milling the upper and/or lower side of the rolling ingot may be carried out between the first and second homogenizations, particularly preferably after the rolling ingot has cooled to room temperature.

In a further embodiment of the method, the degree of rolling reduction during cold rolling is at least 70%, preferably at least 80%. With this minimum degree of rolling reduction it is possible to achieve a fine-grained microstructure in the aluminium strip with good strength and formability after final annealing.

In a further embodiment of the method, the degree of rolling reduction during cold rolling is at most 90%, preferably at most 85%. With such a maximum degree of rolling reduction it is possible to prevent the elongation values of the aluminium alloy strip from being reduced unacceptably.

In a further embodiment, the process can be carried out particularly economically in that cold rolling is carried out without intermediate annealing. It has been found that the desired properties of the aluminium alloy strip may also be achieved without an intermediate annealing operation. Preferably, production of the aluminium alloy strip also does not involve complicated and expensive continuous strip annealing.

In an alternative embodiment of the method, the aluminium alloy strip undergoes intermediate annealing between two cold rolling passes, particularly at a temperature from 300° C. to 400° C., preferably at a temperature from 330° C. to 370° C. Intermediate annealing may be carried out in a chamber furnace, for example. In particular, the intermediate annealing operation is an intermediate soft annealing of the strip.

Although the production process is complicated by the intermediate annealing step, this also makes it possible to influence the microstructure positively with a relatively thick hot strip, so that the aluminium alloy strip produced has better material properties as a result. Intermediate annealing is preferably performed if the degree of rolling reduction during cold rolling is more than 85% in total, particularly more than 90%. Cold rolling and intermediate annealing are then carried out preferably in such manner that the degree of rolling reduction after intermediate annealing is less than 90%, particularly less than 85%. The degree of rolling reduction after intermediate annealing is particularly preferably between 70% and 90%, especially between 80% and 85%.

The object described above is solved for an aluminium alloy strip that has preferably been produced using one of the methods described above, in that the aluminium alloy strip consists of an alloy according to the invention and has an offset yield strength $R_{p0.2}$ of at least 45 MPa, a uniform elongation $A_g$ of at least 23% and an elongation at break $A_{80mm}$ of at least 30%.

Tests have shown that an aluminium alloy strip is producible from the alloy according to the invention, and particularly also by using the method according to the invention, which strip has the above-mentioned material properties and also good resistance to intercrystalline corrosion and filiform corrosion. Thus, the aluminium alloy strip according to the invention is particularly suitable for components and semi-finished products for motor vehicles, especially for coated components such as interior door components.

The offset yield strength $R_{p0.2}$ is determined according to DIN EN ISO 6892-1:2009. The uniform elongation $A_g$ and elongation at break $A_{80mm}$ are also determined according to DIN EN ISO 6892-1:2009 with a flat tensile test sample according to DIN EN ISO 6892-1:2009, Appendix B, Form 2.

In one embodiment, the aluminium alloy strip has a thickness in the range from 0.2 to 5 mm, preferably from 0.25 to 4 mm, particularly from 0.5 to 3.6 mm. These thickness ranges are particularly favourable for achieving the desired material properties of the aluminium alloy strip.

The object described above is also solved by the use of the aluminium alloy according to the invention described above for semi-finished products or components for motor vehicles, especially for coated components for motor vehicles. It has been found that, with the aluminium alloy, material properties can be achieved that are particularly advantageous for these uses. According to one embodiment, the aluminium alloy can be used particularly advantageously for interior door panels of a motor vehicle.

The object described above is further solved by the use of a metal sheet produced from an aluminium alloy strip according to the invention as a component in the motor vehicle. As described above, the material properties of the aluminium alloy strip and thus also the material properties of a metal sheet made therefrom are particularly suitable for use in the motor vehicle, especially as interior door panels.

Because of its good resistance to filiform corrosion, the aluminium alloy according to the invention, or a product produced from the aluminium alloy strip according to the invention, is particularly preferred for coated, especially painted, components of a motor vehicle.

Further embodiments 1 to 6 of the aluminium alloy, further embodiments 7 to 11 of the method, further embodiments 12 and 13 of the aluminium alloy strip and further embodiments 14 and 15 of the use are described in the following:

1. Aluminium alloy for producing semi-finished products or components for motor vehicles, wherein the alloying components of the aluminium alloy have the following contents in percent by weight:
   Fe≤0.80%,
   Si≤0.50%,
   0.90%≤Mn≤1.50%,
   Mg≤0.25%,
   Cu≤0.20%,
   Cr≤0.05%,
   Ti≤0.05%,
   V≤0.05%,
   Zr≤0.05%,
   the remainder being aluminium, unavoidable impurity elements individually <0.05%, in total <0.15%, and the combined content of Mg and Cu satisfies the following relation in % by weight
   0.15%≤Mg+Cu≤0.25%.
2. Aluminium alloy according to embodiment 1, wherein the aluminium alloy has a Cu content of at most 0.10% by weight and/or a Mg content in the range from 0.06% by weight to 0.20% by weight.
3. Aluminium alloy according to embodiment 1 or 2, wherein the Mg content of the aluminium alloy is greater than the Cu content of the aluminium alloy.
4. Aluminium alloy according to any of embodiments 1 to 3, wherein the aluminium alloy has a Cr content ≤0.02% by weight and/or a V content ≤0.02% by weight and/or a Zr content ≤0.02% by weight, particularly ≤0.01% by weight.

5. Aluminium alloy according to any of embodiments 1 to 4, wherein the aluminium alloy has an Fe content in the range from 0.4 to 0.7% by weight and/or an Si content in the range from 0.1 to 0.25% by weight, and/or an Mn content in the range from 1.0 to 1.2% by weight.
6. Aluminium alloy according to any of embodiments 1 to 5, wherein the aluminium alloy has a Ti content of at least 0.01% by weight.
7. Method for producing an aluminium alloy strip from an aluminium alloy according to one of the embodiments 1 to 6, comprising the following method steps:
   Casting a rolling ingot from an aluminium alloy according to one of the embodiments 1 to 6,
   Homogenizing the rolling ingot at 480° C. to 600° C. for at least 0.5 h;
   Hot rolling the rolling ingot at 280° C. to 500° C. to form an aluminium alloy strip;
   Cold rolling the aluminium alloy strip to final thickness; and
   Subjecting the aluminium alloy strip to recrystallizing final annealing.
8. Method according to embodiment 7, wherein the method also comprises the following method step:
   Milling the upper and/or lower side of the rolling ingot.
9. Method according to embodiment 7 or 8, wherein the homogenization is carried out in at least two stages and comprises the following steps:
   first homogenization at 500° C. to 600° C. for at least 0.5 h; and
   second homogenization at 450° C. to 550° C. for at least 0.5 h.
10. Method according to one of embodiments 7 to 9, wherein the degree of rolling reduction during cold rolling is between 70% and 90%, preferably between 80% and 85%.
11. Method according to one of embodiments 7 to 10, wherein the cold rolling is carried out with or without intermediate annealing.
12. Aluminium alloy strip, particularly produced using a method according to one of the embodiments 7 to 11, wherein the aluminium alloy strip consists of an alloy according to one of the embodiments 1 to 6 and has an offset yield strength $R_{p0.2}$ of at least 45 MPa, a uniform elongation $A_g$ of at least 23% and an elongation at break $A_{80mm}$ of at least 30%.
13. Aluminium alloy strip according to embodiment 12, wherein the aluminium alloy strip has a thickness in the range from 0.2 mm to 5 mm.
14. Use of an aluminium alloy according to one of the embodiments 1 to 6 for semi-finished products or components for motor vehicles, particularly interior door components.
15. Use of a metal sheet produced from an aluminium alloy strip according to embodiment 12 or 13 as a component in the motor vehicle, particularly as an interior door panel.

Further features and advantages of the invention will be evident from the following description of several embodiments, wherein reference is also made to accompanying drawing.

DETAILED DESCRIPTION OF THE INVENTION

Figure 1:
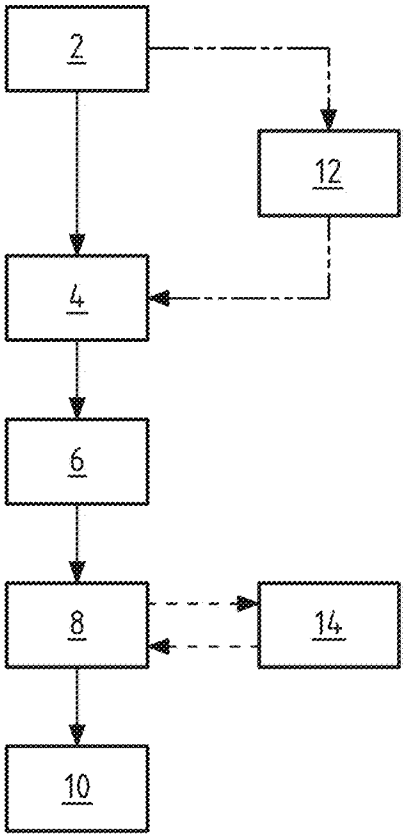
FIG. 1 shows a flowchart for multiple exemplary embodiments of the method according to the invention.

FIG. 1 shows a flowchart for a first exemplary embodiment of the method according to the invention for producing an aluminium alloy strip.

In a first step 2, a rolling ingot is first cast from an aluminium alloy according to the invention. Casting can be carried out for example in a DC continuous casting or strip casting process. After casting, the rolling ingot is homogenized in step 4 at a temperature in the range from 480° C. to 600° C. for at least 0.5 h. In step 6, the rolling ingot is then hot rolled at a temperature in the range from 280° C. to 500° C. to a final thickness between 3 and 12 mm. In step 8, the hot strip that has been hot-rolled from the rolling ingot is then cold rolled to a final thickness of preferably 0.2 mm to 5 mm. Finally, after cold rolling, final annealing of the aluminium alloy strip is performed in step 10, for example in a chamber furnace at a temperature between 300° C. and 400° C. or in a continuous furnace between 450° C. and 550° C.

The upper and/or lower side of the rolling ingot may be milled in an optional step 12 between the casting in step 2 and the homogenization in step 4.

Further, the aluminium alloy strip may undergo intermediate annealing in an optional step 14 during cold rolling in step 8, preferably in a chamber furnace at a temperature between 300° C. and 400° C. Intermediate annealing is particularly useful for improving the material properties of the aluminium alloy strip if the hot strip is relatively thick and if the degree of rolling reduction during cold rolling is thus in total more than 85%, particularly more than 90%.

With a hot strip thickness of 12 mm and a final thickness of 0.4 mm, the total degree of rolling reduction in cold rolling is, for example, 96.7%. In this case, the hot strip may first be rolled for example to a thickness of 2 mm in a first cold rolling pass, then subjected to intermediate annealing and finally rolled to 0.4 mm in a second cold rolling pass. The degree of rolling reduction after the intermediate annealing step is then only 80% and thus lies in a preferred range.

Figure 2:
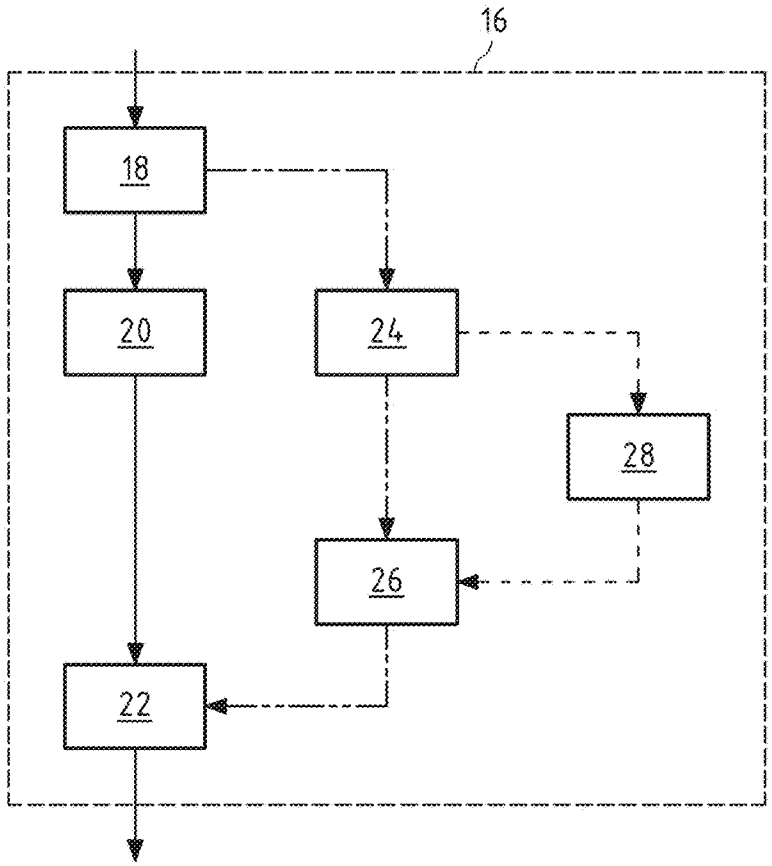
FIG. 2 shows a flowchart for further exemplary embodiments of the method according to the invention.

FIG. 2 shows a part of a flowchart for further exemplary embodiments of the method according to the invention. The process flow for these exemplary embodiments is substantially the same as the process flow for the methods described with reference to FIG. 1. In the exemplary embodiments according to FIG. 2, the rolling ingot is however homogenized in step 16 rather than in step 4, wherein step 16 is divided into several substeps. FIG. 2 shows possible sequences of the individual steps in step 16.

Accordingly, after the rolling ingot is cast in step 2 or after the rolling ingot is milled in step 12, in the first substep 18 of step 16, a first homogenization is carried out at a temperature between 550 and 600° C. for at least 0.5 h, preferably for at least for 2 h. In a subsequent step 20, the rolling ingot is cooled to the temperature for the second homogenization in the range from 450° C. to 550° C., before then in subsequent step 22 undergoing the second homogenization at this temperature for at least 0.5 h, preferably at least 2 h.

Alternatively, in a step 24, the rolling ingot may first be cooled to room temperature after the first homogenization in step 18, and then in a subsequent step 26 be reheated to the temperature for the second homogenization. The upper and/or lower side of the rolling ingot may optionally be milled between step 24 and step 26.

In the course of the invention, AA 3xxx type aluminium alloys, particularly basing on AA 3103, were produced with various contents of Mg and Cu. The compositions of these aluminium alloys are summarized in the following Table 1, wherein the contents of the individual alloying components are each indicated in % by weight.

TABLE 1

| No. | | Si | Fe | Cu | Mn | Mg | Cr | Zn | Ti | V | Zr | Cu + Mg |
|---|---|---|---|---|---|---|---|---|---|---|---|---|
| 1 | V | 0.063 | 0.54 | 0.0029 | 1.07 | 0.0102 | 0.0005 | 0.0051 | 0.0053 | 0.0038 | 0.0005 | 0.013 |
| 2 | V | 0.23 | 0.55 | 0.055 | 0.93 | 0.059 | 0.0096 | 0.0131 | 0.0151 | 0.0099 | 0.0008 | 0.114 |
| 3 | V | 0.208 | 0.546 | 0.064 | 1.026 | 0.071 | 0.004 | 0.005 | 0.018 | 0.0081 | 0.0006 | 0.135 |
| 4 | E | 0.154 | 0.51 | 0.152 | 1.02 | 0.0019 | 0.0005 | 0.0034 | 0.0602 | 0.0073 | 0.0005 | 0.154 |
| 5 | E | 0.176 | 0.511 | 0.092 | 1.01 | 0.063 | 0.003 | 0.006 | 0.0169 | 0.0107 | 0.0008 | 0.155 |
| 6 | E | 0.128 | 0.57 | 0.031 | 1.0 | 0.15 | 0.006 | 0.007 | 0.0166 | 0.0114 | 0.0008 | 0.181 |
| 7 | E | 0.23 | 0.5 | 0.18 | 1.06 | 0.0109 | 0.0101 | 0.0055 | 0.0093 | 0.0112 | 0.0008 | 0.191 |
| 8 | E | 0.142 | 0.62 | 0.0019 | 1.1 | 0.19 | 0.0004 | 0.0011 | 0.0066 | 0.0091 | 0.0005 | 0.192 |
| 9 | E | 0.17 | 0.54 | 0.19 | 1.03 | 0.053 | 0.0005 | 0.0032 | 0.0217 | 0.0064 | 0.0005 | 0.243 |
| 10 | V | 0.42 | 0.45 | 0.086 | 1.01 | 0.19 | 0.0331 | 0.0058 | 0.028 | 0.0066 | 0.0006 | 0.276 |
| 11 | V | 0.052 | 0.21 | 0.28 | 0.87 | 0.22 | 0.0006 | 0.0028 | 0.018 | 0.0061 | 0.0005 | 0.5 |
| 12 | V | 0.162 | 0.59 | 0.0016 | 1.1 | 0.52 | 0.0002 | 0.001 | 0.0055 | 0.0072 | 0.0005 | 0.522 |
| 13 | V | 0.179 | 0.38 | 0.116 | 1.05 | 0.51 | 0.003 | 0.006 | 0.014 | 0.0068 | 0.0006 | 0.626 |

In the last column of Table 1, the combined content of copper and magnesium is indicated, which has been found to be particularly important for the desired material properties. Alloys 4-9 are exemplary embodiments of the inventive alloy (E), while alloys 1-3 and 10-13 represent comparative examples (V).

Aluminium alloy strips were then prepared from said aluminium alloys 1-13 using the method described above. Specifically, in each case a rolling ingot having a thickness of 600 mm was cast from each of said alloys 1 to 13 in DC continuous casting, and then homogenized in two stages, first for several hours at about 580° C. and then for several hours at about 500° C. After homogenization, the ingots were hot-rolled at about 500° C. to create aluminium alloy hot-rolled strips with a thickness of 4 to 8 mm. These aluminium alloy hot rolled strips were then each cold rolled to a final thickness of 1.2 mm and finally subjected to recrystallizing final annealing at 350° C. for 1 h.

Then, the mechanical properties of the aluminium alloy strips were tested, in particular their strength and formability.

The results of these tests are summarized in Table 2 below. The last row of Table 2 also shows the corresponding material properties of a type AA 8006 alloy as known from the prior art.

TABLE 2

| No. | | $R_{p0.2}$ [MPa] | $R_m$ [MPa] | $A_g$ [%] | $A_{80\,mm}$ [%] | n-value | r-value | SZ 32 [mm] |
|---|---|---|---|---|---|---|---|---|
| 1 | V | 42 | 101 | 25.1 | 41.3 | 0.214 | 0.472 | 16.7 |
| 2 | V | 42 | 103 | 24.6 | 35.7 | 0.216 | 0.579 | 16.3 |
| 3 | V | 43 | 111 | 24.5 | 36.1 | 0.218 | 0.484 | 16.4 |
| 4 | E | 48 | 111 | 25.3 | 35.9 | 0.214 | 0.417 | 16.6 |
| 5 | E | 45 | 114 | 24.8 | 36.4 | 0.217 | 0.484 | 16.5 |
| 6 | E | 46 | 116 | 24.5 | 35.1 | 0.217 | 0.662 | 16.7 |
| 7 | E | 49 | 115 | 25.1 | 34.2 | 0.218 | 0.420 | 16.2 |
| 8 | E | 50 | 113 | 24.2 | 35.0 | 0.210 | 0.598 | 16.4 |
| 9 | E | 53 | 118 | 23.8 | 32.5 | 0.216 | 0.344 | 15.9 |
| 10 | V | 51 | 119 | 21.8 | 29.5 | 0.207 | 0.635 | 15.9 |
| 11 | V | 58 | 134 | 21.2 | 26.9 | 0.220 | 0.556 | 15.4 |
| 12 | V | 57 | 135 | 20.8 | 28.0 | 0.221 | 0.652 | 15.5 |
| 13 | V | 66 | 152 | 19.7 | 21.0 | 0.225 | 0.582 | 14.9 |
| AA 8006 | V | 49 | 104 | 27.5 | 42.0 | 0.223 | 0.431 | 17.3 |

Table 2 shows the following values:

- offset yield strength $R_{p0.2}$ in MPa and the tensile strength $R_m$ in MPa, measured in the tensile test perpendicular to the rolling direction of the sheet according to DIN EN ISO 6892-1:2009,
- uniform elongation $A_g$ as a percentage and elongation at break $A_{80mm}$ as a percentage, measured in a tensile test perpendicular to the rolling direction of the sheet with a strip tensile test sample according to DIN EN ISO 6892-1:2009, Appendix B, Form 2,
- the strain hardening exponent n (n-value) measured in the tensile test perpendicularly to the rolling direction of the sheet according to DIN ISO 10275:2009,
- the perpendicular anisotropy r (r-value) measured in the tensile test perpendicularly to the rolling direction of the sheet according to DIN ISO 10113:2009, and
- the cupping SZ 32 achieved during stretch forming in millimetres as a further measure of the ductility of the alloy. Cupping SZ 32 was determined in the Erichsen cupping test according to DIN EN ISO 20482, but with a punch head diameter of 32 mm and die diameter of 35.4 mm tuned to the sheet thickness and with the aid of a Teflon drawing film to reduce friction.

Figure 3:
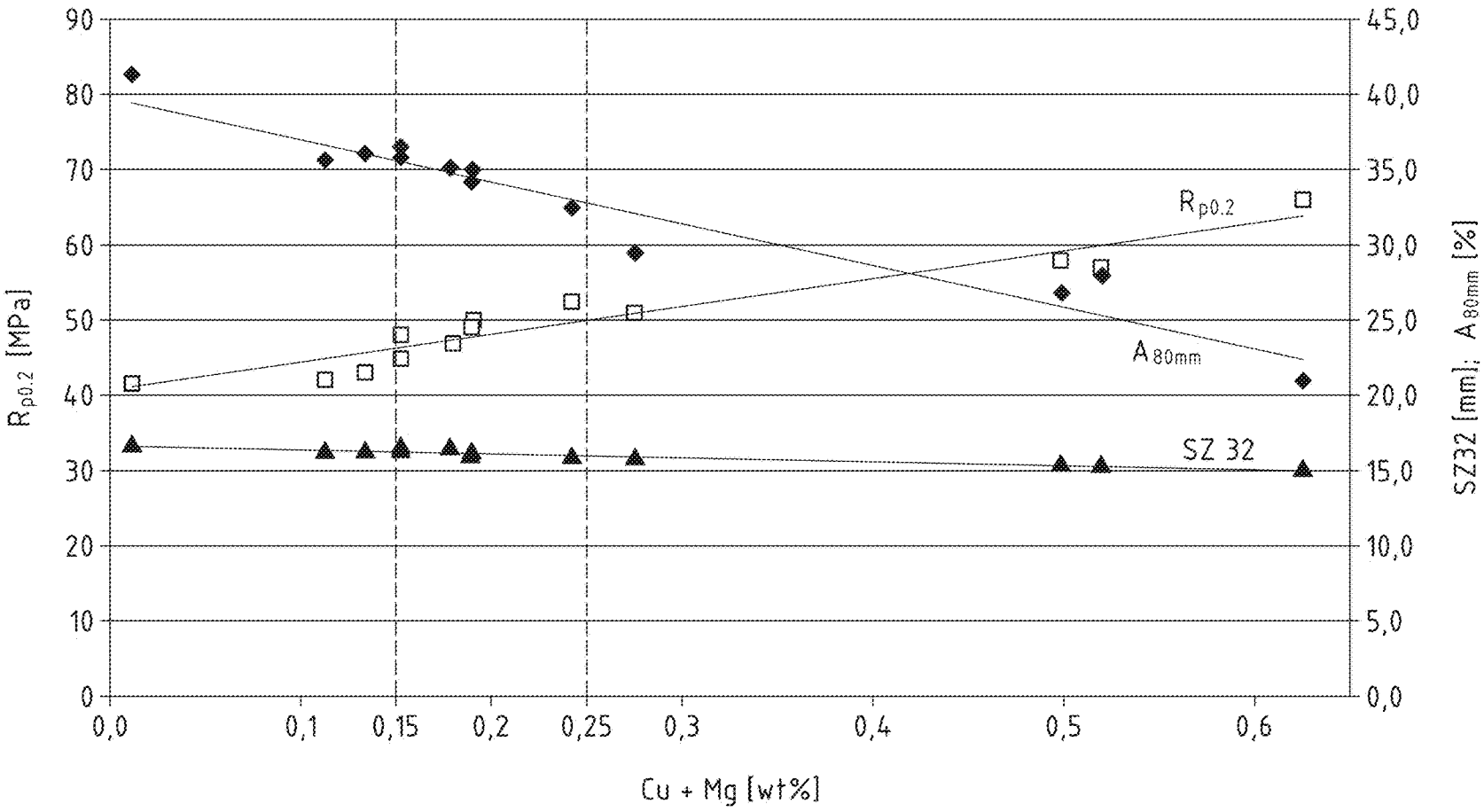
FIG. 3 shows a diagram with measurement results from exemplary embodiments of the alloy and/or aluminium alloy strip according to the invention.

In FIG. 3, the offset yield strengths $R_{p0.2}$ (empty squares), elongations at break $A_{80mm}$ (filled diamonds) and the cupping values SZ 32 (filled triangles) of aluminium alloy strips 1 to 13 are plotted against the combined Cu and Mg content of the respective aluminium alloy. The $R_{p0.2}$ values are plotted in MPa according to the scale on the left vertical axis. The $A_{80mm}$ values are plotted in percent and the SZ 32 values are plotted in mm according to the scale on the right vertical axis. The combined Cu and Mg content is indicated on the abscissa in % by weight.

For better clarity, straight lines of best fit are also added in FIG. 3 for each of the measured values for $R_{p0.2}$, $A_{80mm}$ and SZ 32. Two vertical dashed lines further indicate the upper and lower limits for combined Cu and Mg content according to the present invention.

As the measured values for the aluminium alloy strips from aluminium alloys 4-9 show, adjusting the combined Cu and Mg content in a range from 0.15% by weight to 0.25% by weight has the effect of achieving the desired combination of strength ($Rp_{0.2}$≥45 MPa) and formability ($A_g$≥23% and $A_{80mm}$≥30%).

With a combined Mg and Cu content of less than 0.15% by weight (No. 1-3) the strength proves to be too low ($R_{p0.2}$<45 MPa) and with a combined Mg and Cu content of more than 0.25% by weight (numbers 10-13) the elongation values and therewith also the formability are reduced too much ($A_g$<23% and/or $A_{80mm}$<30%).

The good formability is also particularly evident from the measured cupping value, which preferably has a value SZ 32≥15.8 mm, preferably ≥15.9 mm for the alloy according to the invention.

As a result, for the same strength, aluminium alloys 4-9 thus exhibit only slightly worse formability than the comparative alloy AA 8006. However, aluminium alloys 4-9 have an advantage over alloy AA 8006, in that they have significantly better corrosion resistance. Particularly, intercrystalline corrosion generally does not occur in AA 3xxx type aluminium alloys.

Moreover, supplementary laboratory tests for corrosion resistance were performed on the aluminium alloy strips made from aluminium alloys 4-9. These laboratory experiments showed that aluminium alloys 4-9 exhibit much better resistance to filiform corrosion than the alloy type AA 8006. Thus, aluminium alloys like the aluminium alloys 4-9 and aluminium alloy strips produced from said aluminium alloys are particularly suitable for coated components.

In particular, the test for filiform corrosion as described in the following was conducted on sheet samples of each of the various aluminium alloy strips. The test comprises the following steps in the given order:

1. Etching of the rolled and soft annealed sheet samples for 30 s in an acid etching medium with material removal of 0.5 g/m$^3$. (This material removal corresponds roughly to a typical material removal during pretreatment of semi-finished products and components for motor vehicles, for example in an OEM pretreatment process, so that the filiform results of the test described here correlate well with the results in the actual component.)
2. Coating the etched sheet sample with a transparent acrylic resin paint.
3. Baking the applied paint for 5 min. at 160° C.
4. Using a scriber needle to make a scratch in the sheet sample transversely to the direction of rolling.
5. Droplet seeding of an aqueous, 18% hydrochloric acid solution in the scratch.
6. Ageing of the sheet sample in a climatic exposure test cabinet,
   a) initially for 24 h at 40° C. and 80% relative humidity, and
   b) then for 72 h at 23° C. and 65% relative humidity.
7. Visual evaluation of the sheet sample, namely evaluation of the infiltration depth (spread of corrosion under the paint) originating from the scratch.

Figure 4A:
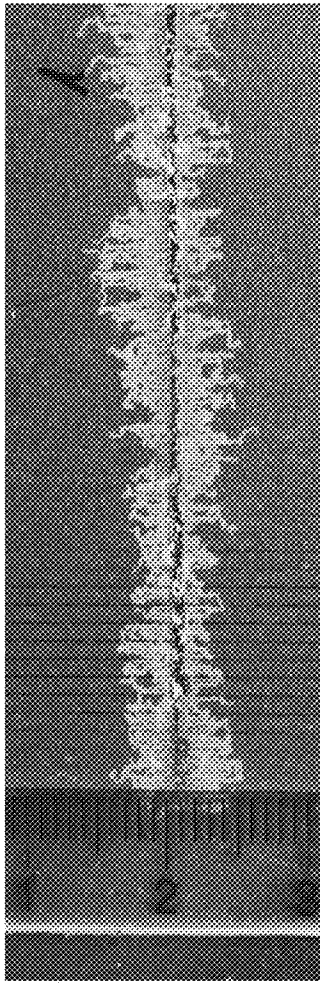
FIGS. 4*a-c* show photographic images of three metal sheet samples from three different aluminium alloy strips regarding a test for filiform corrosion.
Figure 4B:
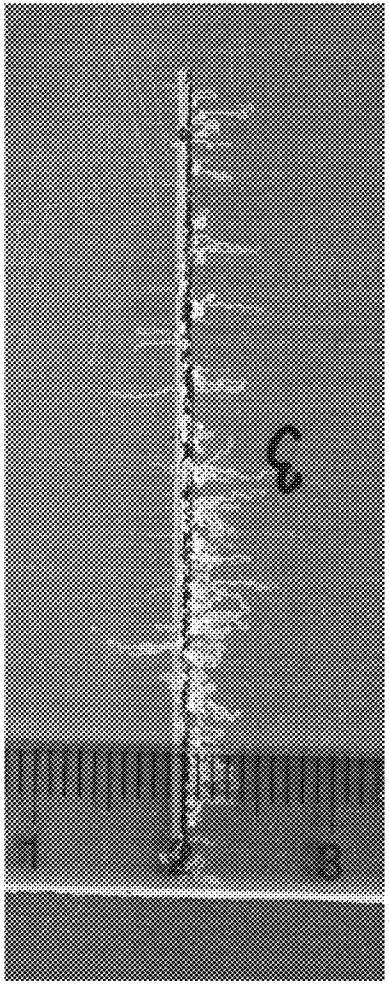
Figure 4C:
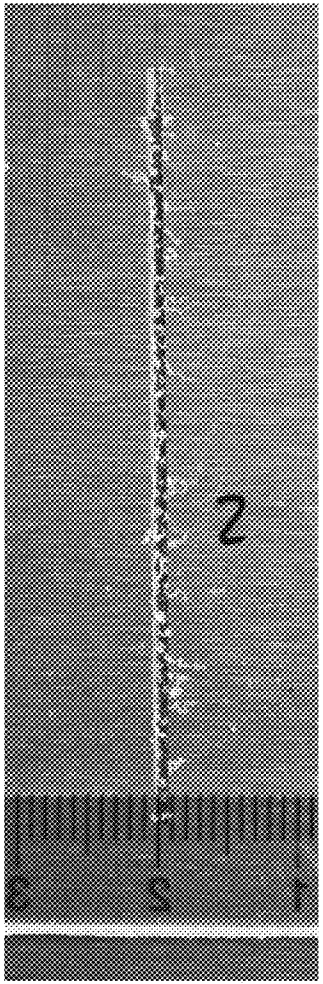

The test described in the preceding was conducted in particular on sheet samples of exemplary embodiments 5 and 6 listed in tables 1 and 2, and on a sheet sample produced in corresponding manner from the comparison alloy AA8006. FIGS. 4*a-c* are photographic images of the sheet sample surfaces at the end of the test. FIG. 4*a* shows the sheet sample from the comparison alloy AA8006, FIG. 4*b* shows the sheet sample according to exemplary embodiment 5 and FIG. 4*c* shows the sheet sample according to exemplary embodiment 6.

The scratch made in each sheet sample is visible in each of FIGS. 4*a-c* (dark line extending from top to bottom). Filiform corrosion emanates from the scratch substantially transversely to the direction of extension of the scratch and appears in the figures as pale, thread-like structures. To facilitate size comparison, each figure shows a ruler with centimetre scale placed on the sheet sample.

The sheet sample from the comparison alloy AA8006 exhibits substantial filiform corrosion. The scratch in FIG. 4*a* is almost completely surrounded by the white, thread-like structures of filiform corrosion. The infiltration depth, that is to say the length of the thread-like structures originating from the scratch, is up to 6 mm.

In contrast, the level of the filiform corrosion on the sheet sample produced from alloy 5 is considerably lower. The density of the thread-like filiform corrosion structures is much smaller on the scratch shown in FIG. 4*b* than on the scratch shown in FIG. 4*a*, indicating that the sheet sample in FIG. 4*b* is much more resistant to filiform corrosion than the sheet sample in FIG. 4*a*. Nevertheless, some thread-like filiform corrosion structures still appear on this sheet sample as well, and in some regions the infiltration depth is quite extensive, up to about 6 mm.

The best results with regard to filiform corrosion were obtained with the exemplary embodiments in which the Mg content of the alloying composition is greater than the Cu content. Accordingly, the sheet sample for exemplary embodiment 6 with an Mg content of 0.15% by weight and a Cu content of 0.031% by weight exhibits only minimal filiform corrosion. Only very few short, thread-like filiform corrosion structures less than 3 mm in length sporadically surround the scratch in FIG. 4*c*. The sheet sample of exemplary embodiment 6 thus exhibits very good resistance to filiform corrosion.

Finally, the measured values in table 2 show that the exemplary embodiments of the aluminium alloy according to the invention can also return good values for tensile strength $R_m$ as well as for the n value and the r value, which in particular are in the same range as conventional AA 3xxx alloys, or even better.

Figure 5:
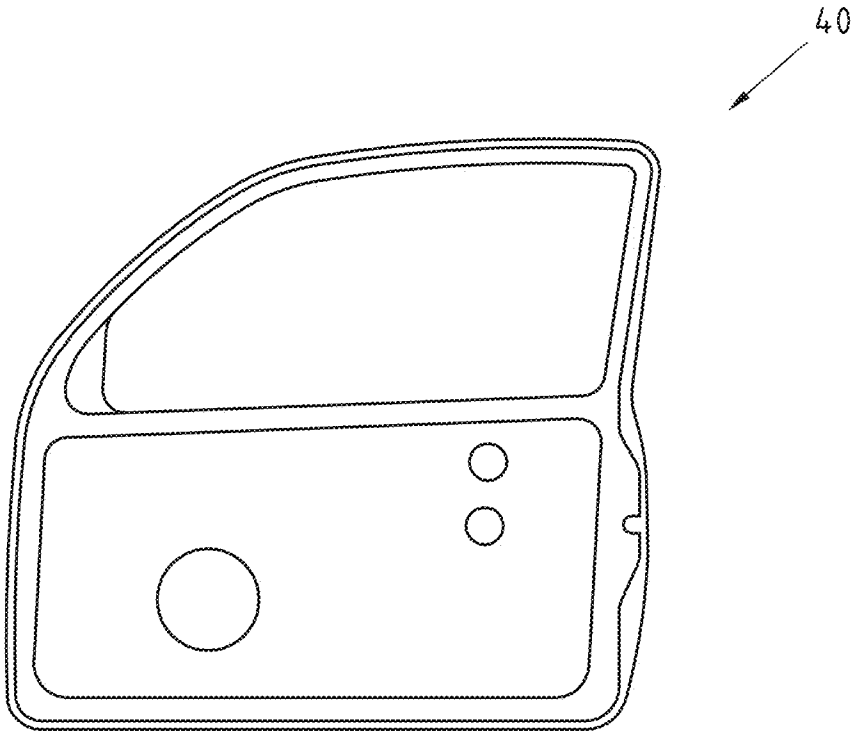
FIG. 5 shows a component for a motor vehicle according to a further exemplary embodiment.

FIG. 5 is a schematic representation of a typical component of a motor vehicle in the form of an interior door panel. Such interior door panels 40 are usually made of steel. However, for the same stiffness, steel components are heavy and prone to corrosion.

It has been found that the aluminium alloys described in the preceding, such as for example aluminium alloys 4-9, can be used to produce aluminium alloy strips that have very good formability, are of medium strength and highly resistant to corrosion, particularly intercrystalline as well as filiform corrosion.

The material properties of these aluminium alloy strips and the sheets prepared from them are thus particularly advantageous for producing motor vehicle components, such as interior door panel 40. The good resistance to filiform corrosion is especially advantageous when the aluminium alloys are used for coated, particularly painted, parts such as interior door panel 40.

In particular, the components produced from these aluminium alloys have better resistance to corrosion than corresponding components made of steel or an AA 8006 type alloy. At the same time, they are considerably lighter than steel components.

The invention claimed is:

1. An aluminium alloy strip, produced by a method comprising the following method steps:

Casting a rolling ingot from an aluminium alloy for producing semi-finished products or components for motor vehicles, wherein the alloying components of the aluminium alloy have the following contents in percent by weight:

Fe≤0.80%,
Si≤0.50%,
0.90%≤Mn≤1.50%,
Mg≤0.25%
Cu≤0.125%,
Cr≤0.05%,
Ti≤0.05%,
V≤0.05%,
Zr≤0.05%, the remainder being aluminium, unavoidable impurity elements individually <0.05%, in total <0.15%, and the combined content of Mg and Cu satisfies the following relation in percent by weight 0.15%≤Mg+Cu≤0.25% wherein the Mg content of the aluminium alloy is greater than the Cu content of the aluminium alloy;

Homogenizing the rolling ingot at 480° C. to 600° C. for at least 0.5 h;

Hot rolling the rolling ingot at 280° C. to 500° C. to form an aluminium alloy strip;

Cold rolling the aluminium alloy strip to final thickness; and

Subjecting the aluminium alloy strip to recrystallizing final annealing;

wherein the aluminium alloy strip consists of an alloy having the following contents in percent by weight:

Fe≤0.80%,
Si≤0.50%,
0.90%≤Mn≤1.50%,
Mg≤0.25%,
Cu≤0.125%,
Cr≤0.05%,
Ti≤0.05%,
V≤0.05%,
Zr≤0.05%, the remainder being aluminium, unavoidable impurity elements individually <0.05%, in total <0.15%, and the combined content of Mg and Cu satisfies the following relation in percent by weight 0.15%≤Mg+Cu≤0.25% wherein the Mg content of the aluminium alloy is greater than the Cu content of the aluminium alloy, and wherein the aluminium strip has an offset yield strength $R_{p0.2}$ of at least 45 MPa, a uniform elongation $A_g$ of at least 23%, and an elongation at break $A_{80\ mm}$ of at least 30%.

2. The aluminium alloy strip according to claim 1, wherein the aluminium alloy strip has a thickness in the range from 0.2 mm to 5 mm.

3. A method of fabricating a component in a motor vehicle, comprising the steps of:

making a metal sheet from the aluminium alloy strip according to claim 1; and utilizing the metal sheet to fabricate the component in the motor vehicle.

4. The method according to claim 3, wherein component in a motor vehicle is an interior door panel.

5. The aluminium alloy strip according to claim 1, wherein the method further comprises the following method step:

Milling the upper and/or lower side of the rolling ingot.

6. The aluminium alloy strip according to claim 1, wherein homogenization is carried out in at least two stages and comprises the following steps:

first homogenization at 500° C. to 600° C. for at least 0.5 h; and second homogenization at 450° C. to 550° C. for at least 0.5 h.

7. The aluminium alloy strip according to claim 1, wherein the degree of rolling reduction during cold rolling is between 70% and 90%.

8. The aluminium alloy strip according to claim 7, wherein the degree of rolling reduction during cold rolling is between 80% and 85%.

9. The aluminium alloy strip according to claim 1, wherein the cold rolling is carried out with or without intermediate annealing.

* * * * *